United States Patent [19]

Harvey

[11] Patent Number: 4,912,863

[45] Date of Patent: Apr. 3, 1990

[54] MODULAR PICTURE FRAME SYSTEM

[76] Inventor: Fitzgerald Harvey, 109-32 208th St., Queens Village, N.Y. 11429

[21] Appl. No.: 252,563

[22] Filed: Sep. 30, 1988

[51] Int. Cl.[4] ..... G09F 1/12

[52] U.S. Cl. ..... 40/152

[58] Field of Search ..... 40/152, 152.1, 605

[56] References Cited

U.S. PATENT DOCUMENTS

| | | | |
|---|---|---|---|
| 3,523,382 | 8/1970 | Dreyer | 40/152 |
| 3,673,724 | 7/1972 | Bell et al. | 40/152 |
| 4,043,477 | 8/1977 | Deese | 40/152 |
| 4,115,938 | 9/1978 | Belmuth et al. | 40/152 |
| 4,562,656 | 1/1986 | Kristofich | 40/152 |

FOREIGN PATENT DOCUMENTS

| | | | |
|---|---|---|---|
| 2231297 | 12/1974 | France | 40/152 |

*Primary Examiner*—Cary E. Stone

*Attorney, Agent, or Firm*—Abelman Frayne Rezac & Schwab

[57] ABSTRACT

A modular picture frame for use in an assemblage of such frames has slots which extend inwardly of a base of the frame, and into which an end of a connecting bar can be inserted and secured, the other end of the connecting bar then being insertable and securable within a similar slot of another modular picture frame.

14 Claims, ~~4~~ 3 Drawing Sheets

FIG. 2
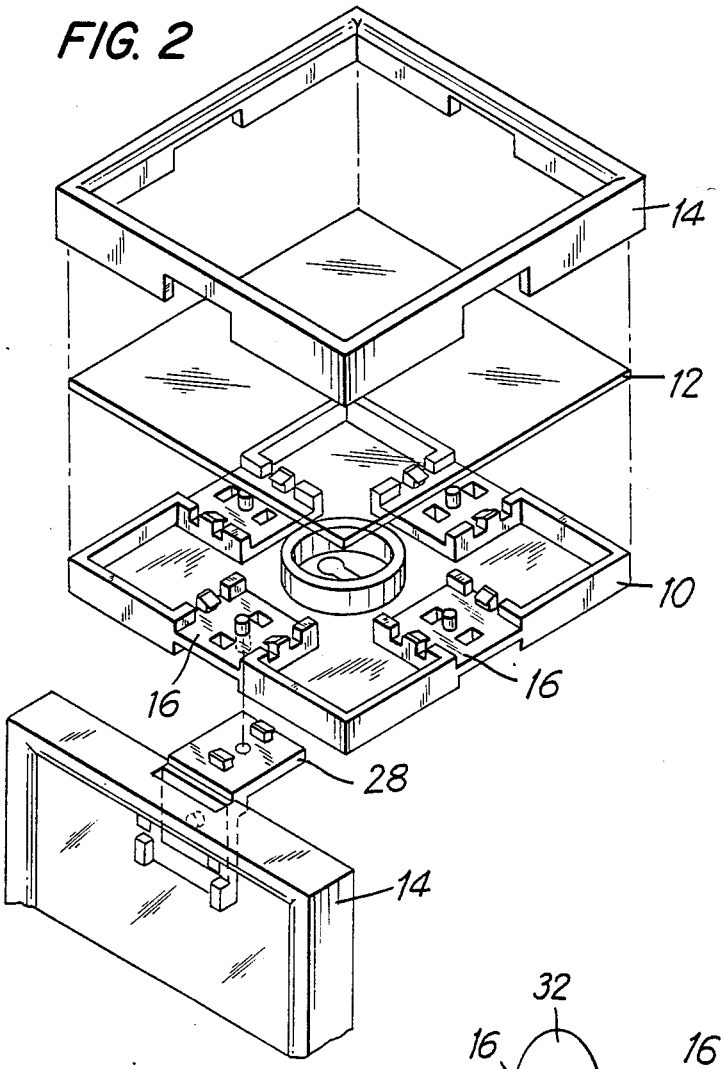
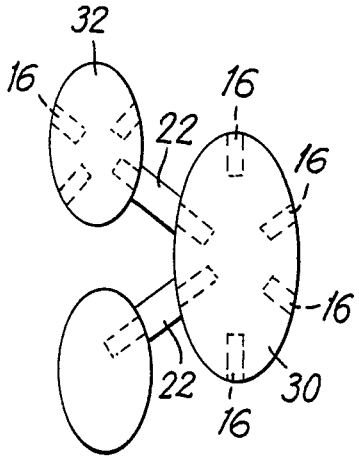
FIG. 5A

MODULAR PICTURE FRAME SYSTEM

FIELD OF THE INVENTION

This invention relates to a system of modular picture frames to be assembled one to the other in any desired grouping and in any desired number to provide either a wall-hanging display, or, to provide a free-standing display of a plurality of pictures such as photographs, prints, paintings and the like.

BACKGROUND OF THE INVENTION

It is well-known to provide pictures frames of various sizes to accommodate photographs of standard sizes and which are to be individually hung on a wall. It is, however, a tedious operation to individually mount such picture frames on a wall as individual units, particularly in a geometric pattern in which alignment of the frames one with the other is required to provide the required symmetry of the assemblage.

It is also known to provide assemblages of picture frames in the form of a cube. Such cubes are, however, limited to the display of a maximum of five photographs, each of identical dimensions one with the other, and the faces thereof are not interchangeable.

SUMMARY OF THE INVENTION

It is an object of this invention to provide a system of modular picture-frames that can be connected one to the other as a unitary assembly of any desired configuration and organization to provide a wall-hanging, or, which can be connected one to the other to provide a free-standing unitary assemblage of any desired size, configuration and organization.

While not limited thereto, the respective modules of the assemblage may be square or rectangular, each rectangular module having dimensions on two respective pairs of sides that is the same as, or a multiplication of the dimension on each of the sides of a square module.

Alternatively, the respective modules of the assemblage can be of any polygonal, circular or elliptical shape as desired in order to provide an assemblage of picture frames of desired form.

THE INVENTIVE CONCEPT

According to the present invention, a system of modular picture frames includes means interconnecting adjacent pairs of modules substantially rigidly one to the other, the interconnecting means being rigidly attachable to the said pairs of modules during the assembly of the modules into a desired assemblage.

The interconnecting means can be comprised of bars of metal or plastics material which extend into strategically located sockets in the respective adjacent pair of modules, and which are lockable within the sockets to hold the respective modules rigidly connected one to the other.

The bars can be flat bars of metal or plastics material, or, they can be rods or tubes of circular or elliptical cross-section, and can either themselves provide the required immobilizing engagement with the respective modules by suitable formation of the ends of the bars for interconnecting inter-engagement with the respective modules, or, the modules can be appropriately formed for interlocking engagement with the bars, or both.

Optionally, and in the event that the modules are to be assembled in a spaced arrangement in the assemblage, the bars can be decoratively surfacefinished over at least those portions that are to remain exposed. Also, they can be decoratively contoured to simulate beading, carving, fret-work and the like to further enhance the decorative appearance of the finished assemblage.

Further, the bars can be other than axially straight, and can be angled or curved at their mid-sections, this permitting the assemblage of the modules into free-standing formations or three-dimensional wall-hangings.

DESCRIPTION OF THE DRAWINGS

The invention will now be discussed with reference to the accompanying drawings, which illustrate preferred embodiments of the invention, and in which:

FIG. 2 is an exploded perspective view of an alternative preferred embodiment of the invention;

FIGS. 5 and 5A are diagrammatic illustration of an assembleye of circular frames, and an assembleye of elliptical frames;

DESCRIPTION OF THE PREFERRED EMBODIMENTS

Figure 1:
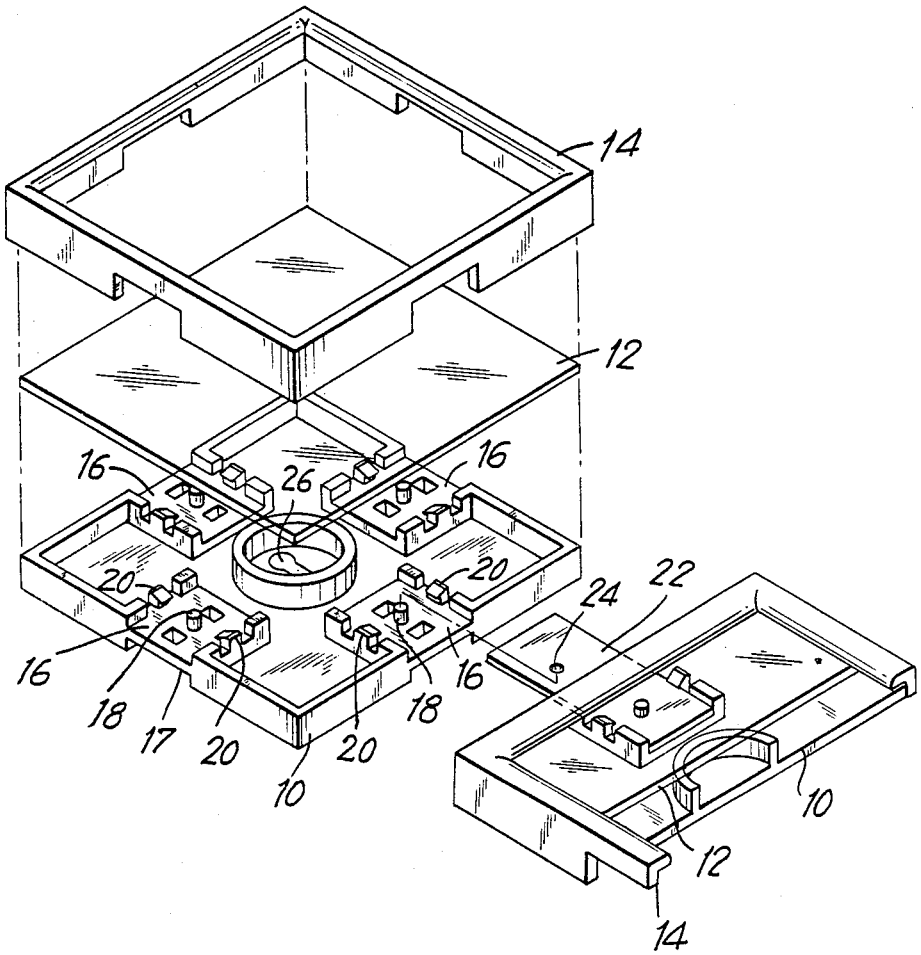
FIG. 1 is an exploded perspective view of one preferred embodiment of the invention.

Referring firstly to FIG. 1, there is shown a first modular frame in exploded view, and is shown an identical frame in cross-section in the process of being assembled to the first frame to provide an assemblage of modular construction.

Each frame includes a base 10, a sheet 12 of transparent material, such as glass or polymethacrylate overlying the base 10, and a frame 14 which is a snap-fit over the base 10.

As illustrated, the modular frame is square, and is provided with a slot 16 positioned centrally of each of its sides. Each of the slots includes securing means identical with those of each other slot, the securing means comprising a retaining pin 18, and snap-lugs 20 arranged at the lateral sides of the slots.

The slots 16 are of a size to snugly receive a connecting bar 22, the connecting bar 22 having a aperture 24 for the reception of a retaining pin 18.

As is illustrated in FIGS. 1 and 2, instead of or in addition to providing the slots 16 in the front face of the base 10, identical slots 17 can be provided in the rear face of the base.

As will be apparent from FIG. 1, prior to the installation of the transparent sheet 12 and the frame 14, any number of bases 10 can be arranged in any desired number to provide a symmetrical array of the bases. Each base 10 can then be rigidly connected to the adjacent base 10 by pressing a bar 22 downwardly over a pin 18, until such time as the bars snap into position behind the associated snap lugs 20.

As will be appreciated, numerous variations of connection of the bars 22 to the respective bases 10 will suggest themselves to persons knowledgeable in the art. The actual form of the snap connection is not critical, provided that it provides a substantially rigid interconnection between a base 10 and an associated bar 22. For example, the snap lugs 20 and pins 18 could be substituted by apertures in the bases 10 and the connecting bars 22 for the reception of a self-tapping screw, such as a sheet metal screw.

Having secured the respective bases to each other in the desired configuration of the assemblage, then, the transparent sheets 12 and the frames 14 can be positioned over the bases, the entire assemblage then being handleable as a unit.

Preferably each of the bases is provided with a central keyhole slot 26 or aperture for the reception of the head of a screw or nail, in a manner well-known in the art, such that the assemblage then can be hung on a wall as a wall decoration or display.

Such an assemblage can be made in any one of an infinite number of combinations, as is later discussed with reference to FIGS. 3–7.

Referring now to FIG. 2, the same pair of bases 10 as those shown in FIG. 1 are illustrated in combination with a right-angled bar 28, whereby the respective bases can be connected to each other in right-angled configuration. By adding further frames and right-angled bars 28, an assemblage of cube form can be made of the modular frames.

As will readily be appreciated, each face of the cube could be a planar assemblage of frames in the manner discussed with reference to FIG. 1, thus providing multiple frames, for example four frames, on each face of the assembled cube.

Again, in view of the modular construction of the frames, any assemblage in a multitude of variations can be made of the frames, such as is now discussed with reference to FIGS. 3 through 7.

Figure 3:
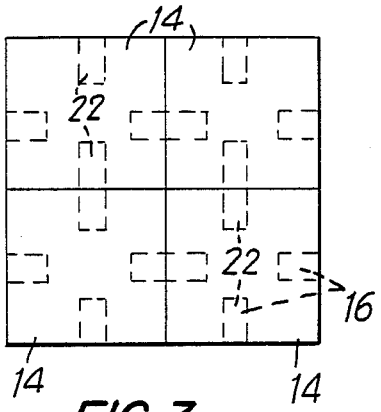
FIG. 3 is a diagrammatic view illustrating an assemblage of four identical rectangular frames.

In FIG. 3, four square modular frames 14 are shown interconnected with each other by bars 22, in order to form a modular assemblage of four frames in the shape of a larger square. As will be readily apparent, additional frames can be added as desired to the periphery of the assemblage by inserting connecting bars 22 into the other available slots 16 in the respective frames.

Figure 4:
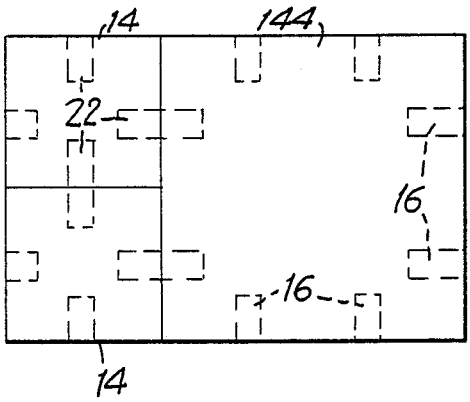
FIG. 4 is a diagrammatic representation of an assemblage of rectangular frames of different dimensions.

This concept is further developed in FIG. 4, in which a pair of square modular frames are connected to a larger sized square modular frame 144, the modular frame 144 being provided with slots 16 strategically located to be aligned with the slots 16 of the frames 14. As in FIG. 3, the assemblage is interconnected by bars 22 received within matching pairs of slots 16, again to form a rigid assemblage adapted to be hung on a wall.

As was discussed with reference to FIG. 3, a multitude of variations in the assemblage can be made by the addition of further modular frames, continuing, if desired, to make a pave of an entire wall as a decorative addition thereto.

The concept of the present invention is not limited to square or rectangular frames, nor is it limited to the frames being affixed to each other in butting relationship.

Figure 5:
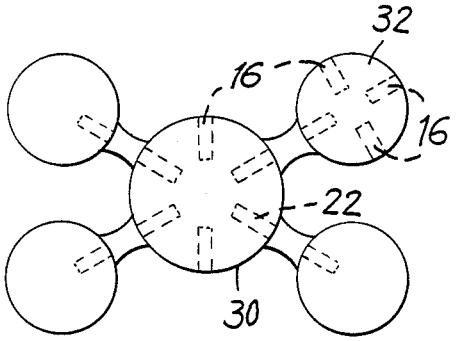

As illustrated in FIG. 5, a central modular frame of circular form can be provided with a spoke-like array of slots 16, each adapted to receive a connecting bar 22, by means of which a modular frame of different size or shape, such as the circular frames 32 can be connected thereto in a sunburst or latticework array.

Further, by providing the bars 22 with enlarged midportions as illustrated in FIG. 5, the adjacent frames can be secured to each other in spaced relationship. Again, the number of possible arrangements is limited only by the placement of the slots 16, with the opportunity to continue with the assemblage from any available slot.

In the event that the bars are provided with an enlarged central portion as discussed with respect to FIG. 5, then, the central portion can be decoratively finished in any desired manner to further enhance the appearance of the assemblage. For example, the central portions of the bar could be of polished chrome or brass, or, they could be formed to simulate beads or carvings, or fretted to provide an assemblage having particular characteristics, such as modern, victorian, art deco, etcetera.

As will be further appreciated from a consideration of FIG. 5A, the frames are not restricted to being truly circular. They could be elliptical, or of any curved form provided that a symmetrical array of slots 16 is provided.

Figure 6:
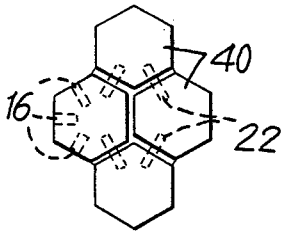
FIG. 6 is an illustration of an assemblage of hexagonal frames.

Further, and as illustrated in FIG. 6, the frames can be of any desired form that will interfit one with the other, such as the hexagonal frames 40 illustrated in FIG. 6.

Figure 7:
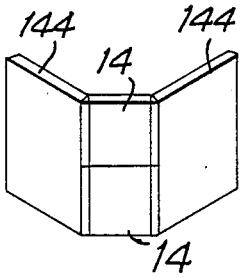
FIG. 7 is a diagrammatic illustration of a three-dimensional free-standing assemblage comprised of a plurality of frames of different sizes.

So far, assemblages of a generally planar form and those in the form of a cube have been discussed. As is illustrated in FIG. 7, by providing suitably angled connecting bars 22, three-dimensional assemblages can be made, such as the free-standing assemblage illustrated in FIG. 7, and which comprises two modular frames 14, and two modular frames 144, the combinations being infinite in their variety and at the choice of the assembler. Further, the bars 22 could be in the form of hinges in order to provide for adjustment of the panels relative to each other.

As will be appreciated, the base and the frame can be made in any convenient manner, and of any suitable material. While it is contemplated that the base 10 and the frame 14 each will be made from a moldable plastics material, they could equally well be formed from other materials, for example, the base 10 could be cast in aluminium, and the frame 14 formed from stainless steel sheeting by techniques that are wellknown in the art.

Various modifications may be made within the scope of the appended claims, the embodiments discussed being preferred embodiments of a multitude of such embodiments falling within the scope of the appended claims.

I claim:

1. A modular picture frame for use in conjunction with at least one other said modular picture frame to provide an assemblage of said frames, said modular picture frame comprising:

a base member formed from a substantially rigid material, said base member having a symmetrical array of slots, each slot opening into the periphery of said base member and being for the reception of a connection bar, said slots being so located that each said slot can be aligned with a said slot in a corresponding base of said other picture frame;

said slots each being sized and formed to receive one end of a rigid eleongate connection bar and including a holding and positioning pin for a reception in a corresponding aperture in an end of a said connecting bar, each said slot being provided with resilient snap lugs adapted to snap over a said end of a said connecting bar to secure said connecting bar within said slot and engaged over and located by said holding and positioning pin; and , a frame member positionable over said base member and securable thereto to hold and secure a picture positioned over said base and within said frame member.

2. The modular frame of claim 1 including a transparent sheet positioned within said frame member and adapted to overlie said picture.

3. The modular picture frame of claim 1, in combination with another said modular picture frame and a said connecting bar, one end of said connecting bar being received and secured within a said slot of one of said modular picture frames, and the other end of said connecting bar being received and secured within a said slot of said other modular picture frame to provide an assemblage of said frames.

4. The combination of claim 3, further including at least one additional said modular picture frame and connecting bar connected to one of said modular picture frame and said another modular picture frame in an identical manner to the connection between said one and said another modular picture frame.

5. The combination of claim 4, in which each said modular picture frame has four linear sides and said slots are located equidistantly from the ends of each said side.

6. The combination of claim 4, in which at least one said modular picture frame has four linear sides, one opposed pair of said sides having a plurality of equidistantly spaced said slots, whereby, a plurality of modular picture frames of smaller size can be connected and secured to said at least one modular picture frame.

7. The combination of claim 4, in which said modular picture frame is circular in planform, and said slots extend radially of said base of said modular picture frame.

8. The combination of claim 4, in which said modular picture frame is elliptical in planform, and said slots extend radially of the intersection of the major and minor axes of said base of said modular picture frame.

9. The combination of claim 4, in which said modular picture frame is polygonal in planform and includes a said slot extending perpendicularly to each linear side of said polygon.

10. The combination of claim 3, in which said connecting bars are axially straight.

11. The combination of claim 10, in which the respective ends of said connecting bars are hinged to each other.

12. The combination of claim 3, in which the respective ends of said connecting bars are angled relative to each other.

13. The combination of claim 3, in which said connecting bars are of a length greater than that required to secure a pair of said modular picture frames in abutting relation.

14. The combination of claim 13, in which the central portions of the connecting bars are of greater dimensions than the respective ends of said connecting bars.

* * * * *